US007360383B1

(12) United States Patent
Chang

(10) Patent No.: US 7,360,383 B1
(45) Date of Patent: Apr. 22, 2008

(54) KEY SHEATH

(76) Inventor: Hsueh-Liang Chang, No. 440, Meiting St., Taichung (TW)

( * ) Notice: Subject to any disclaimer, the term of this patent is extended or adjusted under 35 U.S.C. 154(b) by 0 days.

(21) Appl. No.: 11/645,697

(22) Filed: Dec. 27, 2006

(51) Int. Cl.
*E05B 19/04* (2006.01)
*E05B 19/24* (2006.01)

(52) U.S. Cl. ..... 70/395; 40/330; 40/634; 70/408; 70/413; 70/460

(58) Field of Classification Search ..... 70/276, 70/413, 408, 460, 395, 456 R, 457–459; 24/3.6; 40/330, 634; 206/37.1, 38.1, 37.3, 206/37.4, 37.7
See application file for complete search history.

(56) References Cited

U.S. PATENT DOCUMENTS

| | | | | |
|---|---|---|---|---|
| 1,966,550 | A * | 7/1934 | Handy | 250/465.1 |
| 3,587,260 | A * | 6/1971 | Tajiri | 70/395 |
| 3,841,120 | A * | 10/1974 | Gartner | 70/395 |
| 4,287,735 | A * | 9/1981 | Brunken et al. | 70/395 |
| 4,603,563 | A * | 8/1986 | Mochida et al. | 70/276 |
| 4,716,400 | A * | 12/1987 | Kuribayashi | 340/572.1 |
| 5,181,605 | A * | 1/1993 | Bishop et al. | 206/37.1 |
| 5,383,345 | A * | 1/1995 | Kallinger-Prskawetz-Jacobsen | 70/395 |
| 5,605,066 | A * | 2/1997 | Hurskainen | 70/278.3 |
| 5,746,078 | A * | 5/1998 | Kiernan | 70/424 |
| 6,094,954 | A * | 8/2000 | Carmen | 70/408 |
| 6,189,347 | B1 * | 2/2001 | Thompson | 70/16 |
| 6,367,298 | B1 * | 4/2002 | Janssen et al. | 70/278.3 |
| 6,604,308 | B1 * | 8/2003 | Robles | 40/330 |
| 6,651,470 | B1 * | 11/2003 | Rafter | 70/395 |
| 6,951,122 | B1 * | 10/2005 | Jheng | 70/395 |
| 7,055,352 | B2 * | 6/2006 | Meyerson et al. | 70/456 R |
| 2004/0148988 | A1 * | 8/2004 | Taylor | 70/408 |
| 2005/0072198 | A1 * | 4/2005 | Casellini et al. | 70/408 |
| 2005/0217327 | A1 * | 10/2005 | Frias Frias et al. | 70/395 |

* cited by examiner

*Primary Examiner*—Lloyd A. Gall
(74) *Attorney, Agent, or Firm*—Muncy, Geissler, Olds & Lowe PLLC

(57) ABSTRACT

A key sheath has a casing, an attracting element and a connector. The casing is hollow and has an inserting groove, a chamber, an opening and two mounting holes. The inserting groove is defined in the front end of the casing. The chamber is defined inside the casing and is communicated with the inserting groove. The opening is defined in the rear end of the casing and is communicated with the chamber. The mounting holes are respectively formed through the top and the bottom of the casing near the rear end and are communicated with the chamber. The attracting element is magnetic, is mounted in the chamber of the casing and has a through hole aligned with the mounting holes. The connector is tubular, is connected securely to the casing and the attracting element, and extends through the mounting holes and the through hole.

3 Claims, 7 Drawing Sheets

KEY SHEATH

BACKGROUND OF THE INVENTION

1. Field of the Invention

The present invention relates to a key sheath, and more particularly to a key sheath detachable for a locker.

2. Description of Related Art

With reference to FIG. 6, a conventional locker (53) has a casing, a cover and a lock device (50). The casing has a front side and an opening. The opening is defined in the front side of the casing.

The cover is pivotally connected to the front side of the conventional locker (53) and covers over the opening of the casing.

The lock device (50) is connected to the conventional locker (53) near the cover and has a slot device (52), a keyhole and a key (51). The slot device (52) is mounted on the front side of the conventional locker (53). The key hole is formed in the front side if the conventional locker (53) below the slot device (52). The key (51) is inserted into the keyhole to lock the lock device (50) with the cover.

With reference to FIG. 7, when users put something in the conventional locker (53), they need to put a coin into the slot device (52) and rotate the key (51) to make the lock device (50) locking the cover. After rotating the key (51), users can remove the key (51) from the keyhole and keep the key (51). However, users cannot unlock the cover of the conventional locker (53) when the key (51) is broken or lost, and this is inconvenient.

Therefore, users can assemble an electric controller with the conventional locker (53) to control the cover without using a key (51). However, users may take time to search the conventional locker (53) without the key (51) that always has a number corresponding to the locker (53) and this is time-consuming.

SUMMARY OF THE INVENTION

The main objective of the present invention is to provide a key sheath that can be assembled to a locker easy and quickly.

The key sheath in accordance with the present invention has a casing, an attracting element and a connector. The casing is hollow and has an inserting groove, a chamber, an opening and two mounting holes. The inserting groove is defined in the front end of the casing. The chamber is defined inside the casing and is communicated with the inserting groove. The opening is defined in the rear end of the casing and is communicated with the chamber. The mounting holes are respectively formed through the top and the bottom of the casing near the rear end and are communicated with the chamber. The attracting element is magnetic, is mounted in the chamber of the casing and has a through hole aligned with the mounting holes. The connector is tubular, is connected securely to the casing and the attracting element and extends through the mounting holes and the through hole.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
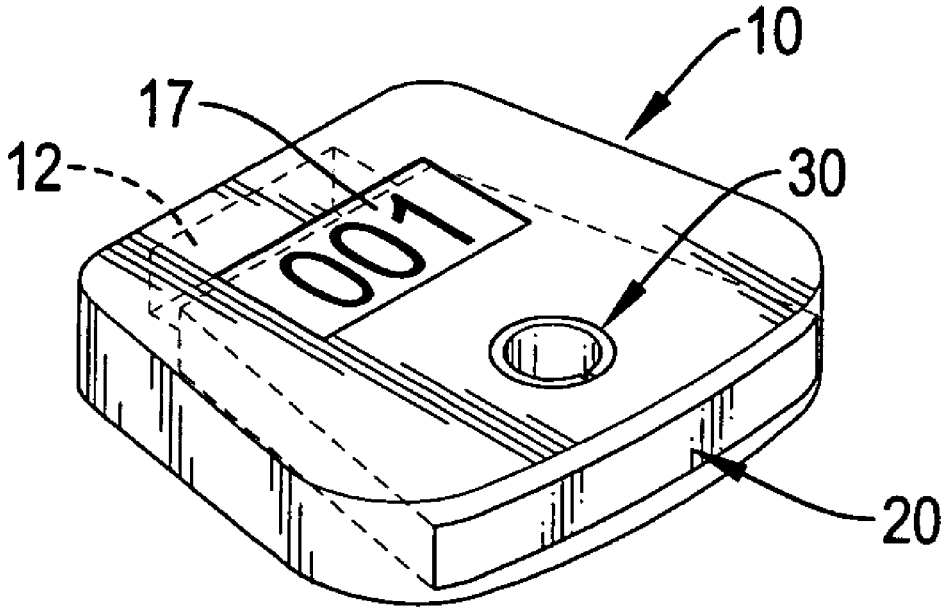
FIG. 1 is a perspective view of a key sheath in accordance with the present invention.

With reference to FIGS. 1 to 4, a key sheath in accordance with the present invention is used for an electric locker (40) having a front side and a stem (41) and comprises a casing (10), an attracting element (20) and a connector (30).

The stem (41) is magnetic and is connected to and inserted into the front side of the electric locker (40).

The casing (10) is hollow, is attached onto the stem (41) of the electric locker (40) and has a front end, a rear end, a top, a bottom, an inserting groove (12), a chamber (11), an opening (13), two mounting holes (14, 15), a label recess (16) and a label (17).

The inserting groove (12) is defined in the front end of the casing (10) and is mounted around one end of the stem (41) of the electric locker (40).

The chamber (11) is defined inside the casing (10) and communicates with the inserting groove (12).

The opening (13) is defined in the rear end of the casing (10) and communicates with the chamber (11).

The mounting holes (14, 15) are respectively formed through the top and the bottom of the casing (10) near the rear end and communicate with the chamber (11).

The label recess (16) is formed in the top of the casing (10) near the front end.

The label (17) is mounted in the label recess (16) and is used to indicate a corresponding electric locker (40).

The attracting element (20) is magnetic, is mounted in the chamber (11) of the casing (10) to attract the stem (41) of the electric locker (40) magnetically and has an inner end, an outer end and a through hole (21). The inner end of the attracting element (20) is inserted into the chamber (11) from the opening (13) and aligns with the inserting groove (12). The outer end of the attracting element (20) is located near the opening (13) of the casing (10). The through hole (21) is formed through the attracting element (20) near the outer end and is aligned with the mounting holes (14, 15) of the casing (10).

Figure 2:
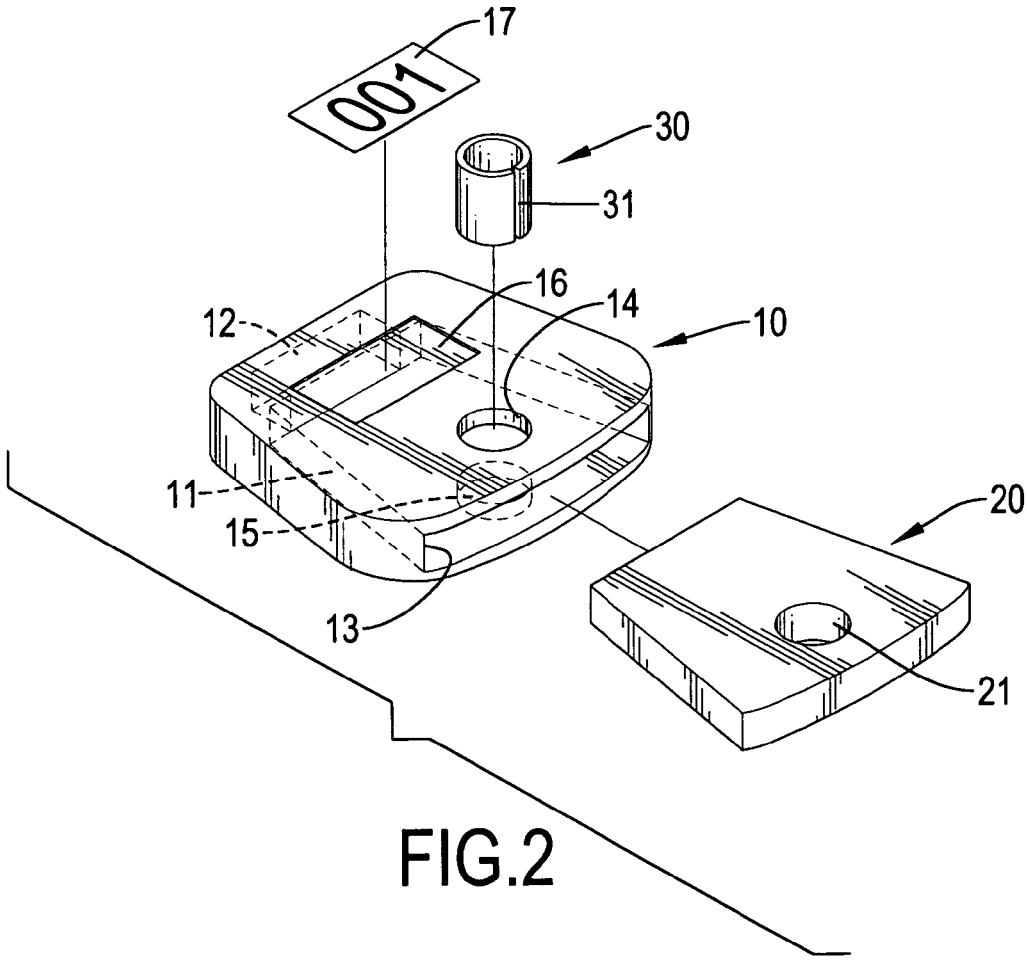
FIG. 2 is an exploded perspective view of the key sheath in FIG. 1.
Figure 5:
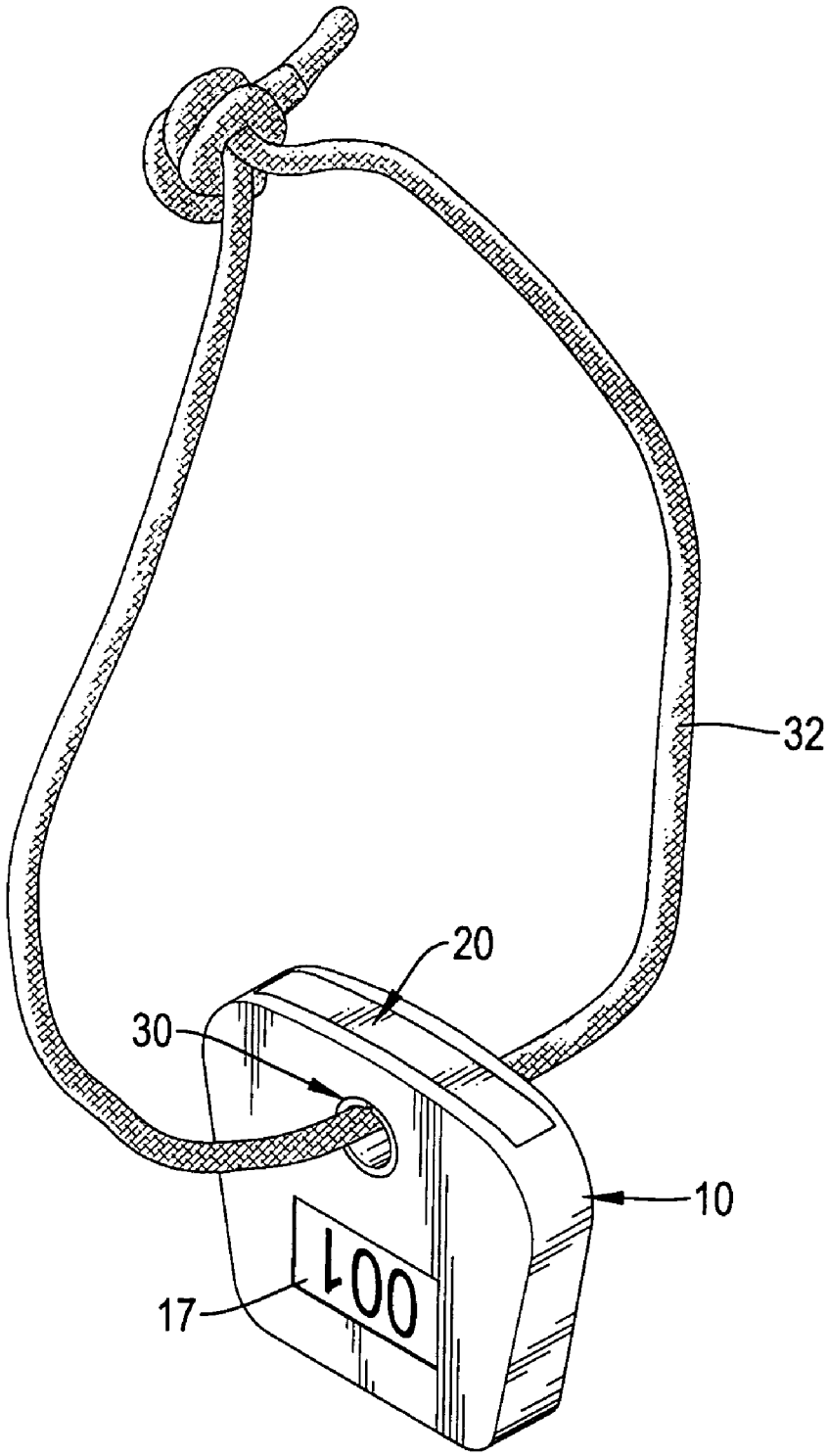
FIG. 5 is a perspective view of the key sheath in FIG. 1 mounted with a string.
Figure 6:
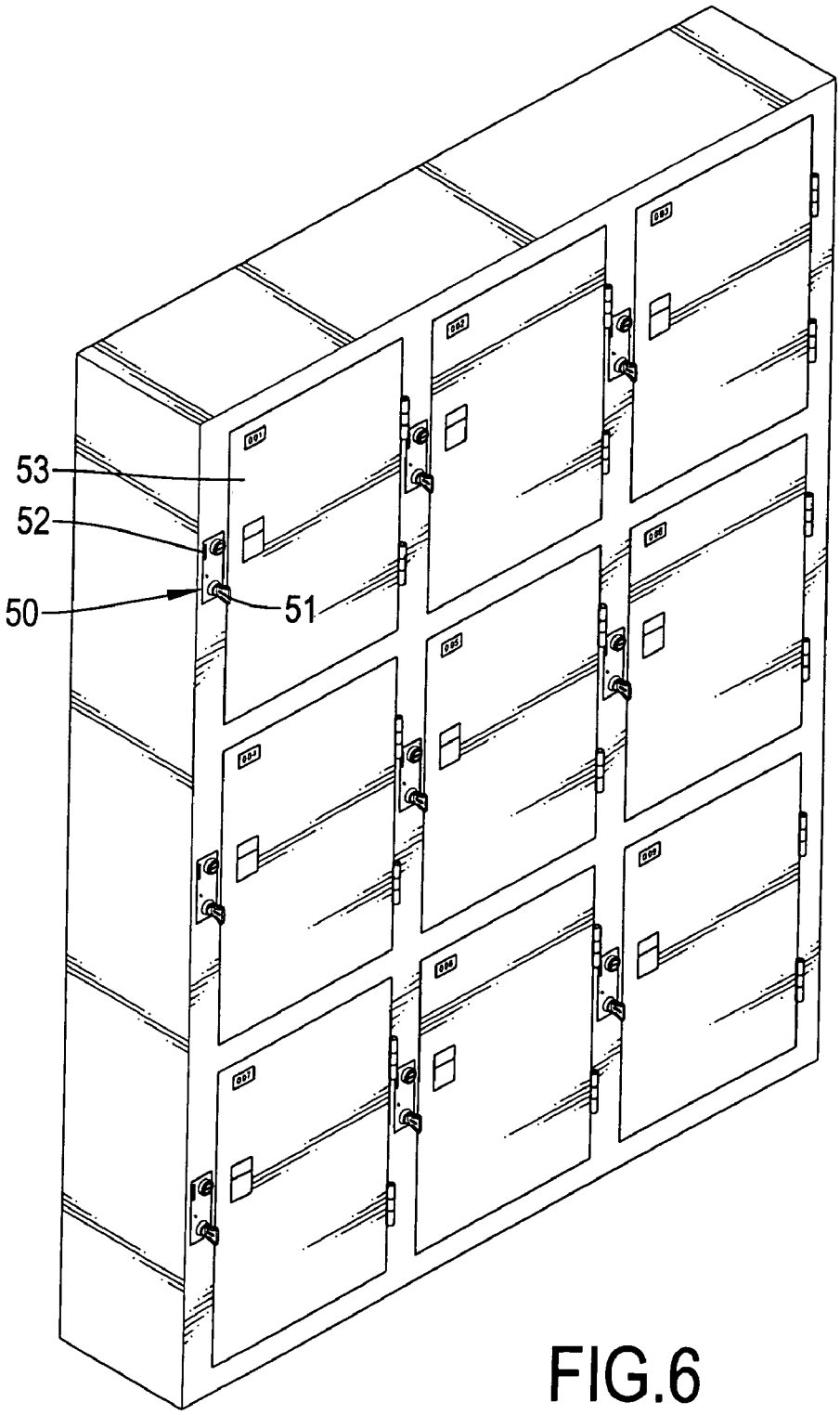
FIG.6 PRIOR ART
FIG. 6 is a perspective view of conventional lockers with keys in accordance with the prior art.
Figure 7:
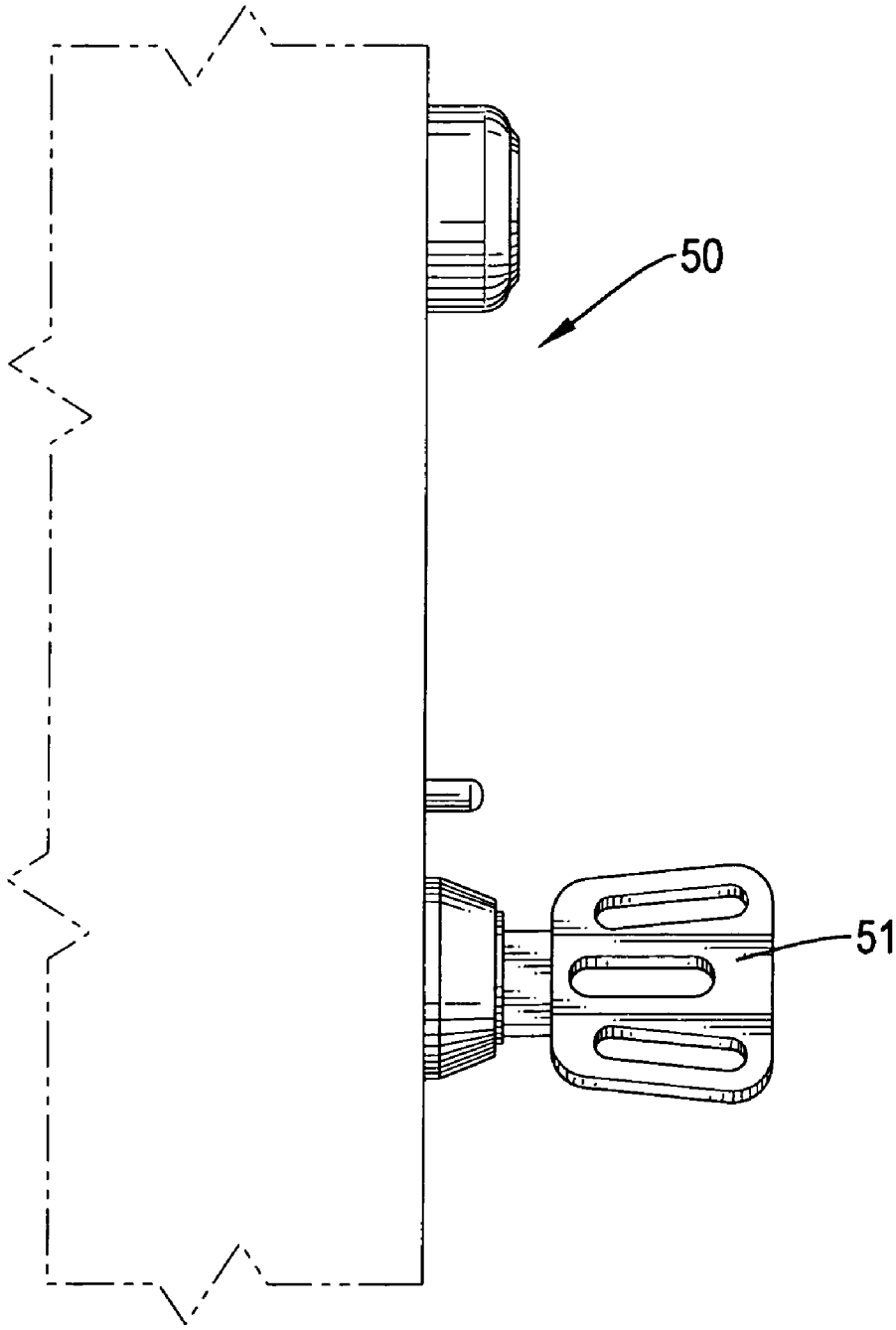
FIG.7 PRIOR ART
FIG. 7 is an operational side view of turning a key for the conventional locker in FIG. 6.

With reference to FIGS. 2 and 5, the connector (30) is tubular and is connected securely to the casing (10) and the attracting element (20). The connector (30) is extended through the mounting holes (14, 15) in the casing (10) and the through hole (21) in the attracting element (20), and has an external surface, a gap (31) and a string (32). The gap (31) is formed axially through the external surface of the connector (30). The string (32) is extended through the connector (30).

Figure 3:
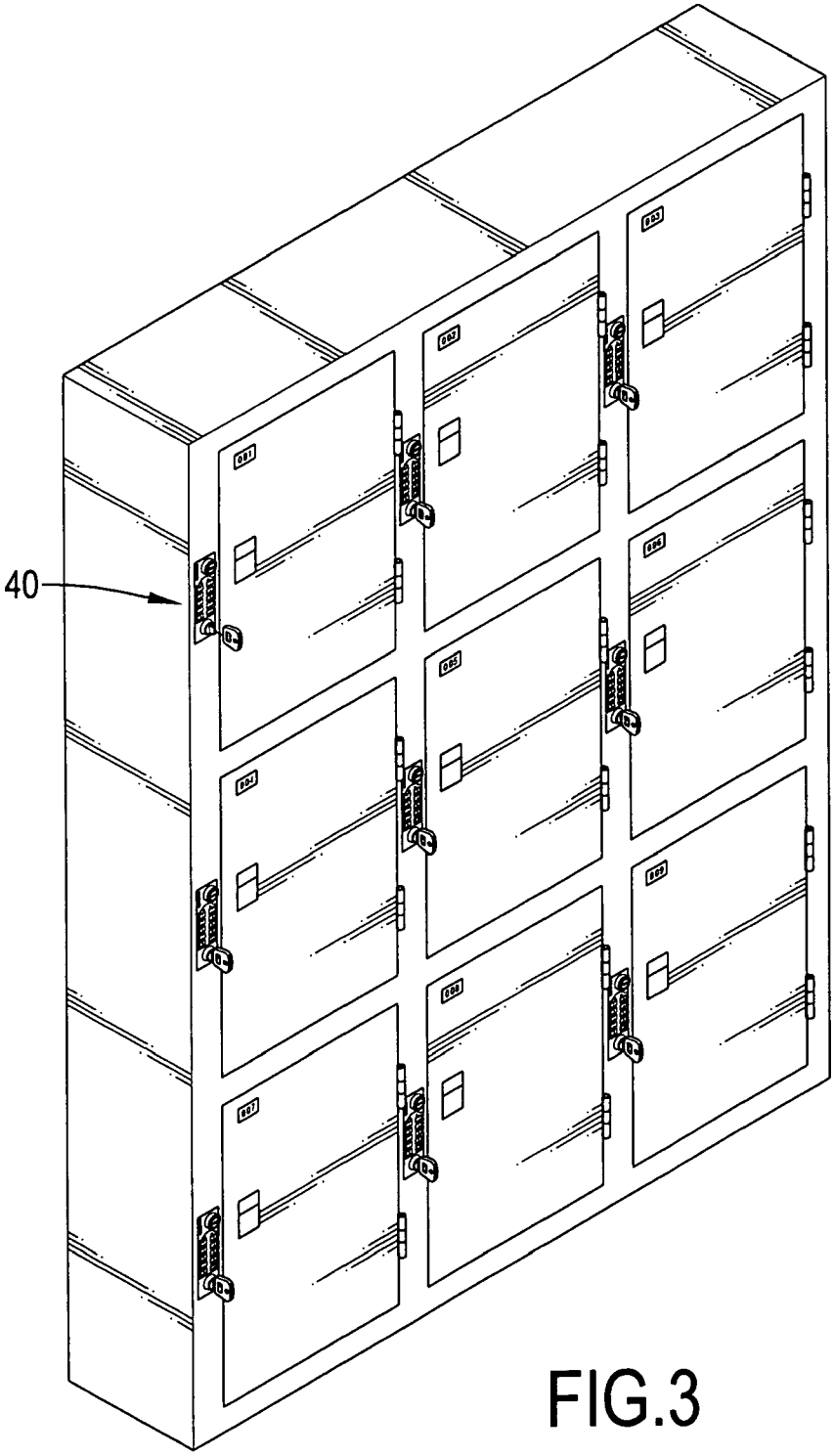
FIG. 3 is an operational view of the key sheath in FIG. 1 on an electric locker.
Figure 4:
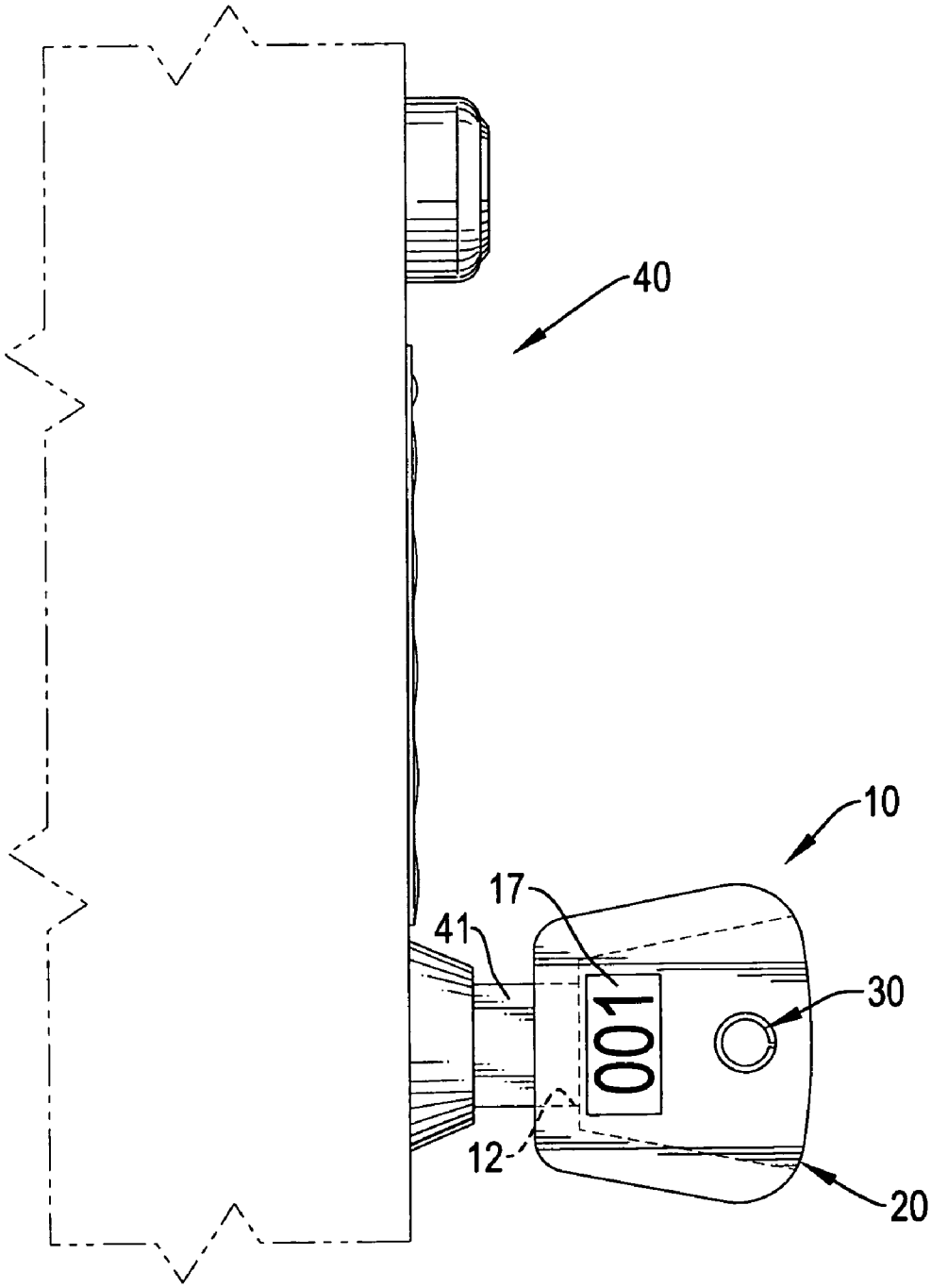
FIG. 4 is an enlarged operational side view of the key sheath on the electric locker in FIG. 3.

With further reference to FIGS. 3 and 4, when users attach the key sheath to the electric locker (40), the inserting groove (12) in the front end of the casing (10) is mounted around one end of the stem (41) of the electric locker (40). Then, the inner end of the attracting element (20) can attract the stem (41) securely to make the key sheath connect to the electric locker (40) with magnetism.

The key sheath as described has the following advantages.

1. Users can attach the key sheath to the electric locker (40) with the magnetism provided by the attracting element (20) and the stem (41), so the key sheath is versatile and convenient in use.

2. The key sheath has a small volume, and users can bring the key sheath everywhere by the string (32). Furthermore, users can find a corresponding electric locker (40) easily and quickly by the label (17) on the casing (10), and this can save the time of users for looking for the corresponding electric locker (40).

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A key sheath comprising a casing being hollow and having a front end;

a rear end;

a top;

a bottom;

an inserting groove being defined in the front end of the casing;

a chamber being defined inside the casing and communicating with the inserting groove;

an opening being defined in the rear end of the casing and communicating with the chamber; and two mounting holes formed respectively through the top and the bottom of the casing near the rear end and communicating with the chamber;

an attracting element being magnetic and being mounted in the chamber of the casing from the opening and having an inner end being inserted into the chamber from the opening and aligning with the inserting groove;

an outer end being located near the opening of the casing, and a through hole being formed through the attracting element near the outer end and being aligned with the mounting holes of the casing; and a connector being tubular, being connected securely to the casing and the attracting element and protruding through the mounting holes in the casing and the through hole in the attracting element and having an external surface; and a gap being formed axially through the external surface of the connector.

2. The key sheath as claimed in claim 1, wherein the casing has a label recess being formed in the top of the casing near the front end; and a label being mounted in the label recess.

3. The key sheath as claimed in claim 1, wherein the connecter has a string extending through the connector.

* * * * *